United States Patent [19]

Kaderabek

[11] 4,261,548

[45] * Apr. 14, 1981

[54] DEVICE FOR HYDRAULIC LIFT OF REINFORCED CONCRETE

[76] Inventor: Lawrence J. Kaderabek, 1129 Lime Kiln Rd., Green Bay, Wis. 54301

[ * ] Notice: The portion of the term of this patent subsequent to Feb. 14, 1996, has been disclaimed.

[21] Appl. No.: 836,581

[22] Filed: Sep. 26, 1977

[51] Int. Cl.[3] ..... B66F 3/00

[52] U.S. Cl. ..... 254/131

[58] Field of Search ..... 254/131, 129, 130, 1; 269/49; 29/252; 294/89

[56] References Cited

U.S. PATENT DOCUMENTS

| | | | |
|---|---|---|---|
| 235,877 | 12/1880 | Jones | 254/130 |
| 543,017 | 7/1895 | Henderson et al. | 294/89 |
| 2,830,789 | 4/1958 | MacMillan | 254/130 |
| 3,957,247 | 5/1976 | Haller et al. | 254/131 |

*Primary Examiner*—Robert C. Watson

*Attorney, Agent, or Firm*—Wheeler, Morsell, House & Fuller

[57] ABSTRACT

A hydraulic jack provided for raising, leveling, and moving steel reinforced concrete. A hole is drilled vertically in the concrete to be lifted, and two wedges, a tapered and a straight wedge are lowered into the aperture in vertical contact. The tapered wedge is lowered into the hole first to protrude under the perifery of the round aperture and the straight wedge run down on the face opposite to the wedge.

1 Claim, 2 Drawing Figures

DEVICE FOR HYDRAULIC LIFT OF REINFORCED CONCRETE

SUMMARY OF THE INVENTION

A concrete jack that utilizes the hydraulic principle that is capable of raising, leveling or of moving steel reinforced concrete slabs. A hole is drilled in the concrete to be lifted and a tapered wedge and a straight wedge are inserted vertically into the hole with the vertical faces in close contact, whereby the wedge portion will be instrumental in raising the reinforced concrete. This is achieved through a mechanical concrete jack consisting of a horizontal brace, a vertical brace and reinforcement bracing, to which are attached hydraulic pistons and casings that exert a downward pressure on concrete surfaces. The downward force on the concrete offset by a lifting force on the under side of concrete to be lifted, pulls the sunken concrete upwardly to an equal level, or desired angle with the existing concrete slab.

DETAILED DESCRIPTION

Figure 1:
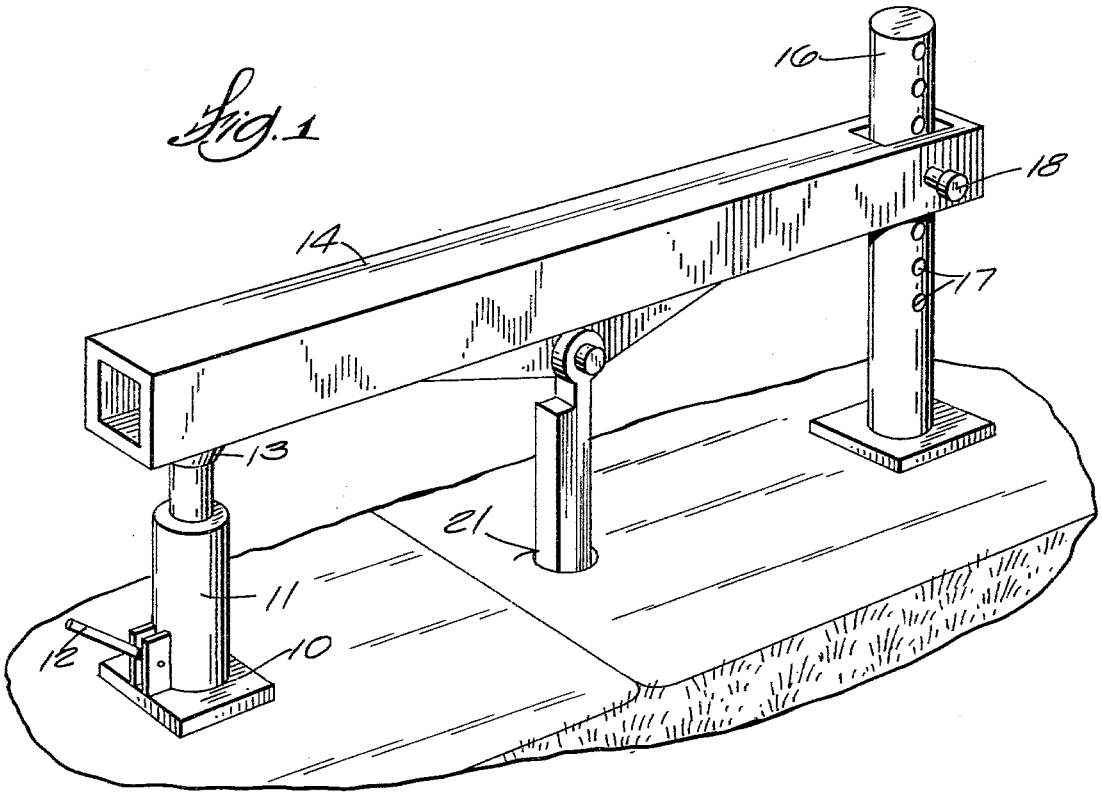
FIG. 1 is a view in perspective from above of the vertical wedges.

The apparatus of the invention includes a jack 11 with a base pad 10, a handle 12 and a cup 13 which, in use, bears against the under surface of a steel beam 14. The jack 11 can be a hydraulic jack. The beam 14 is adjustably connected at one end to a post 16 having a plurality of vertically spaced apertures 17 which receive a pin 18 which extends through apertures in the beam 14. The beam 14 can have a slot (FIG. 1) for receiving the post.

A slab lifting arm 23 is pivotally supported by a pin or bolt 24 to the beam at a point intermediate the length of the beam 14 and the arm 23 is provided with a tapered or wedge-shaped end. The apparatus of the invention also includes a steel bar 22 with parallel faces.

Figure 2:
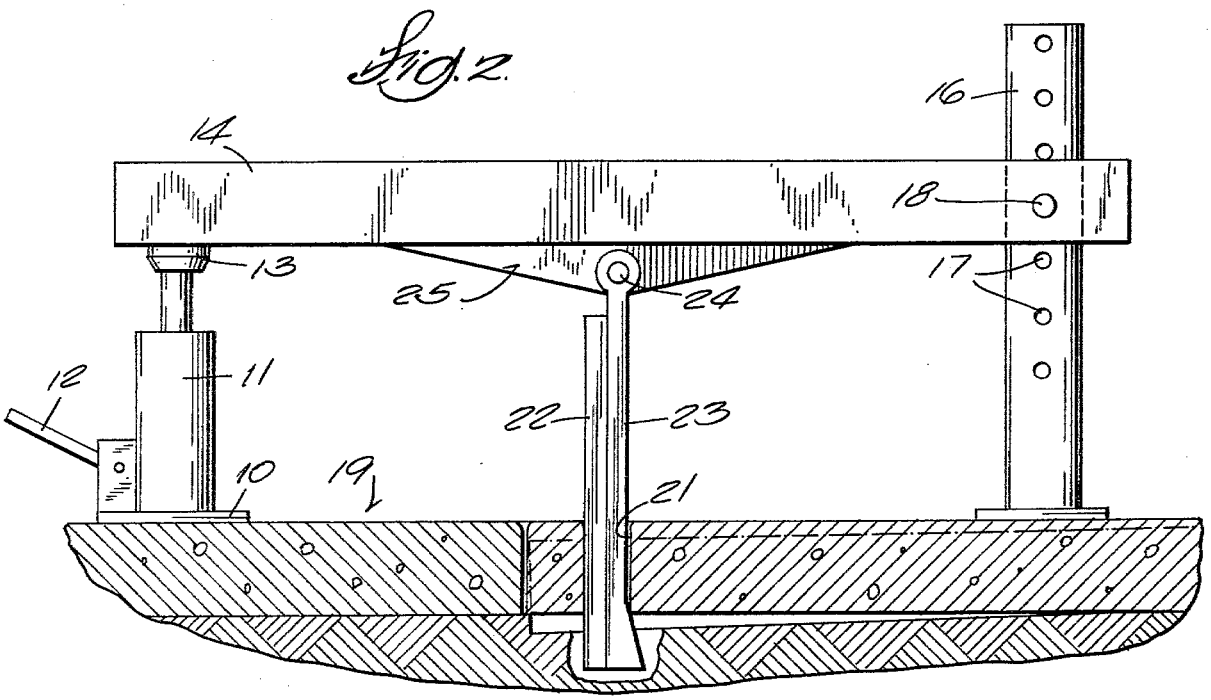
FIG. 2 is a vertical view showing the underground appearance of the straight wedge and the protruding portion of the tapered wedge.

In use, the concrete slab to be elevated is provided with a bore 21 to receive the lifting bar 23. The bar 23 is inserted through the aperture 21 and the bar 22 is inserted in the hole to positively position the inclined surface on bar 23 beneath the slab, as illustrated in FIG. 2. The jack is then operated to lift the slab so that the upper surface is flush with the adjoining slab as illustrated in FIG. 2.

Having thus described the invention, what is claimed and desired to be secured by Letters Patent of the United States, is:

1. Apparatus for elevating sunken concrete slabs comprising a beam with a slot at one end and an aperture, a post with a plurality of spaced apertures with the post interfitting in the slot, a pin for connecting the beam at a selected aperture in said post, a lifting arm pivotally connected to the beam intermediate its length, said lifting arm having a tapered surface adapted to extend through an aperture in the concrete slab and engage the lower edge of a slab, and a positioning bar to back up the arm and positively position the tapered surface beneath the lower edge of the slab, and means for lifting one end of said beam and said lift arm about the pivotal connection with the post to lift the slab.

* * * * *